US008485074B2

(12) United States Patent
Farrell

(10) Patent No.: US 8,485,074 B2
(45) **Date of Patent: *Jul. 16, 2013**

(54) FIREFIGHTER TOOL

(75) Inventor: Terry C. Farrell, Conneaut Lake, PA (US)

(73) Assignee: Channellock, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/857,010

(22) Filed: Sep. 18, 2007

(65) Prior Publication Data

US 2008/0022813 A1 Jan. 31, 2008

Related U.S. Application Data

(63) Continuation-in-part of application No. 11/493,682, filed on Jul. 26, 2006, now abandoned.

(51) Int. Cl.
*B25B 7/22* (2006.01)
*B25F 1/00* (2006.01)

(52) U.S. Cl.
USPC ..... 81/415; 7/127; 7/138; 7/166

(58) Field of Classification Search
USPC ..... 81/125.1, 415, 427.5, 416, 311, 417.5; 7/125–128, 137, 138, 166
See application file for complete search history.

(56) References Cited

U.S. PATENT DOCUMENTS 69,896 A * 10/1867 Bitter ..... 7/127
354,313 A * 12/1886 Galloway ..... 81/424.5
563,577 A * 7/1896 Drum ..... 7/138
930,973 A 8/1909 Kleffman
1,527,772 A * 2/1925 Baird ..... 81/176.1
1,561,647 A 11/1925 Johnson
1,763,353 A * 6/1930 Heller ..... 81/125.1
1,936,359 A 11/1933 Huthsing et al.
D138,515 S 8/1944 Hardy
2,360,163 A 10/1944 Sadler
2,778,254 A 1/1957 Carpellotti
3,142,903 A 8/1964 Stiller
D210,141 S 2/1968 Woods
3,599,255 A 8/1971 Carroll, Sr.
D226,162 S 1/1973 Ziaylek, Jr.
D233,405 S 10/1974 Frey
3,946,453 A 3/1976 Torres
3,949,439 A 4/1976 Ardis
D244,252 S 5/1977 Ardis
4,206,663 A * 6/1980 Pace ..... 81/311
4,287,623 A 9/1981 Tarran
D281,216 S 11/1985 Cutliff, Jr. et al.
4,597,123 A 7/1986 Cobe, Jr.
4,646,378 A 3/1987 Borden
5,062,173 A 11/1991 Collins et al.
5,105,493 A 4/1992 Lugtenaar
D329,972 S 10/1992 Calvagno
D337,492 S 7/1993 Ryan et al.
5,247,715 A 9/1993 Nishiguchi
5,428,853 A 7/1995 Menke (Continued)

*Primary Examiner* — Hadi Shakeri
(74) *Attorney, Agent, or Firm* — Lackenbach Siegel, LLP

(57) ABSTRACT

A firefighter tool has pivotably connected handles and jaws, and one handle has an outer generally sinusoidal surface and the handle end is formed with a hook facingly disposed to the generally sinusoidal surface. The handles open fully so that the user grips the other handle and the sinusoidal surface hook alternately operably contactingly engages differently sized and configured fire hose couplings.

14 Claims, 11 Drawing Sheets

U.S. PATENT DOCUMENTS

| | | | |
|---|---|---|---|
| 5,845,404 | A | 12/1998 | Jeffcoat |
| 5,890,290 | A | 4/1999 | Davis |
| 6,298,754 | B1 | 10/2001 | Brown |
| 6,308,355 | B1 | 10/2001 | McMillan et al. |
| 6,397,420 | B1 | 6/2002 | Roxton |
| 6,598,297 | B1 | 7/2003 | Matt |
| 6,705,182 | B2 | 3/2004 | Bennett |
| 6,899,001 | B1 | 5/2005 | Sanders et al. |
| 2004/0261188 | A1 | 12/2004 | Mathis |
| 2006/0156474 | A1 | 7/2006 | Gillingham |

* cited by examiner

FIREFIGHTER TOOL

PRIOR RELATED APPLICATION

This application is a continuation-in-part of application Ser. No. 11/493,682, filed Jul. 26, 2006, now abandoned, and claims priority thereto and incorporates the priority application herein in its entirety by reference thereto.

BACKGROUND OF THE INVENTION

1. Field of the Invention

This invention relates to hand tools. This invention specifically relates to hand tools having multiple functionalities. This invention more specifically relates to a firefighter tool having multiple functionalities.

2. Background of the Prior Art

Firefighter tools having multiple functions are disclosed in USD210,141, granted Feb. 13, 1968 to Woods; USD226,162, granted Jan. 30, 1973 to Zlayele, Jr., USD233,405, granted Oct. 29, 1974 to Frey; USD244,252, granted May 10, 1997 to Ardis; USD281,216, granted Nov. 5, 1985 to Cutliff, Jr, et al.; USD 329,972, granted Oct. 6, 1992 to Calvagno; U.S. Pat. No. 1,561,647, granted Nov. 17, 1925 to Johnson; U.S. Pat. No. 2,360,163, granted Oct. 10, 1944 to Sadler; U.S. Pat. No. 3,599,255 granted Oct. 21, 1968 to Carroll, Sr.; U.S. Pat. No. 3,949,439, granted Apr. 13, 1976 to Ardis; U.S. Pat. No. 4,287,623, granted Sep. 8, 1981 to Tarran; U.S. Pat. No. 4,597,123, granted Jul. 1, 1986 to Cobe, Jr.; U.S. Pat. No. 4,646,378, granted Mar. 3, 1987 to Borden; U.S. Pat. No. 5,105,493, granted Apr. 21, 1992 to Lugtenaar; U.S. Pat. No. 5,428,853, granted Jul. 4, 1995 to Menke; U.S. Pat. No. 6,308,355, granted Oct. 30, 2001 to McMillan et al.; U.S. Pat. No. 6,397,420, granted Jun. 4, 2002 to Roxton; U.S. Pat. No. 6,899,001, granted May 31, 2005 to Sanders et al.; and US Publication 2004/0261188, published Dec. 30, 2004 to Mathis.

The wrench art generally disclosed a unitary member and hook for effectively engaging one specifically sized coupling as disclosed in USD138,515 to Hardy, USD337,492 to Ryan et al. and U.S. Pat. No. 6,705,182 to Bennett.

The firefighter wrench art was directed to a movable or displaceable hook or other movable element in order to engage diversely sized couplings as disclosed in U.S. Pat. No. 6,298,754 to Brown, U.S. Pat. No. 1,936,359 to Huthsing et al. U.S. Pat. No. 5,428,853 to Menke et al., U.S. Pat. No. 5,247,715 to Nishiguchi.

Referring specifically to FIG. 1 (Prior Art), there is shown the multi-purpose rescue tool disclosed in US Publication No. 2006/015674, published Jul. 20, 2006 to Gillingham ("the Gillingham tool"). The Gillingham tool 1 includes a handle 8 with a planar contact surface 2 for engaging small sized fire hose couplings (not shown), wherein there is line contact between the cylindrical surface of the coupling and the handle planar contact surface 2. The Gillingham hook end 3 is curved with a terminal sharp edge which has a limited range of utility the Gillingham tool is only operable with the handles in the closed position. This is because the handles open to only a limited degree, and the arm 4 and cutter 5 disposed in the inside 6 of handle 7 prevent a user from griping the handle 7.

The art desires a firefighter tool that is operable with diversely sized and configured couplings, and wherein a large force may be asserted to readily and effectively rotate and uncouple the diversely sized and configured couplings, particularly where the couplings are seized tight.

The present invention provides a firefighter tool that meets the foregoing art needs.

SUMMARY OF THE INVENTION

The invention in one principal aspect is a tool member that is a wrench construction having the combination of a generally sinusoidal curvature or surface and a hook disposed at an end of the member and in facing disposition to the generally sinusoidal surface. The combination of the generally sinusoidal surface and the facingly disposed hook permits a user to variously operably engage diversely sized and configured couplings. The present tool engages fire hose couplings of from about 1½" to 5" in diameter having from 2 to 6 lugs or ears. The tool member, in one embodiment, may be of one-piece unitary construction.

The invention, in another respect, is a tool that has two members, and each member has a distal end formed with a jaw, and a proximate end formed with one or more grip portions, and a pivot member disposed between the respective ends, so that as pliers the handles open and close the jaws and one member having the afore-discussed combination of the generally sinusoidal curvature or surface and the facingly disposed hook formed at the proximate end of the one member. The user may employ the wrench with the handles opened or closed. The pliers are configured to open so that the fully opened handles subtend an angle of at least about 70°. The user in one mode of operation grips one handle and exerts a large force, through bearing surfaces on the opened jaws, to the wrench end generally sinusoidal surface and to the hook to quickly open seized fire hose couplings.

The sinusoidal curvature or surface includes a convex surface and a contiguous concave surface. The radii of the convex and concave surfaces are about equal. The concave surface is disposed more adjacent to the proximate end of one member than the distal end. The inflection or transition surface disposed between the concave and convex curvatures is generally the contact engagement surface. With the wrench sinusoidal surface engaging each respective coupling cylindrical surface, there is, in contradistinction to a line contact between the coupling cylindrical surface and of the wrench contact surface of the Gillingham tool, an engagement surface area.

The present hook construction extends from the proximate end to the distal end. The hook distal portion or end face has a generally rectilinear construction and a planar angled face. This hook construction provides an operable bearing surface for diversely sized and configured lugs or ears that extend radially outwardly from the coupling cylindrical surface.

The present firefighter tool is diversely operable with diversely sized and configured fire hose couplings. In use, the present firefighter tool exerts a large torque force and readily rotates and uncouples couplings that are seized tight.

DESCRIPTION OF THE INVENTION

Figure 1:
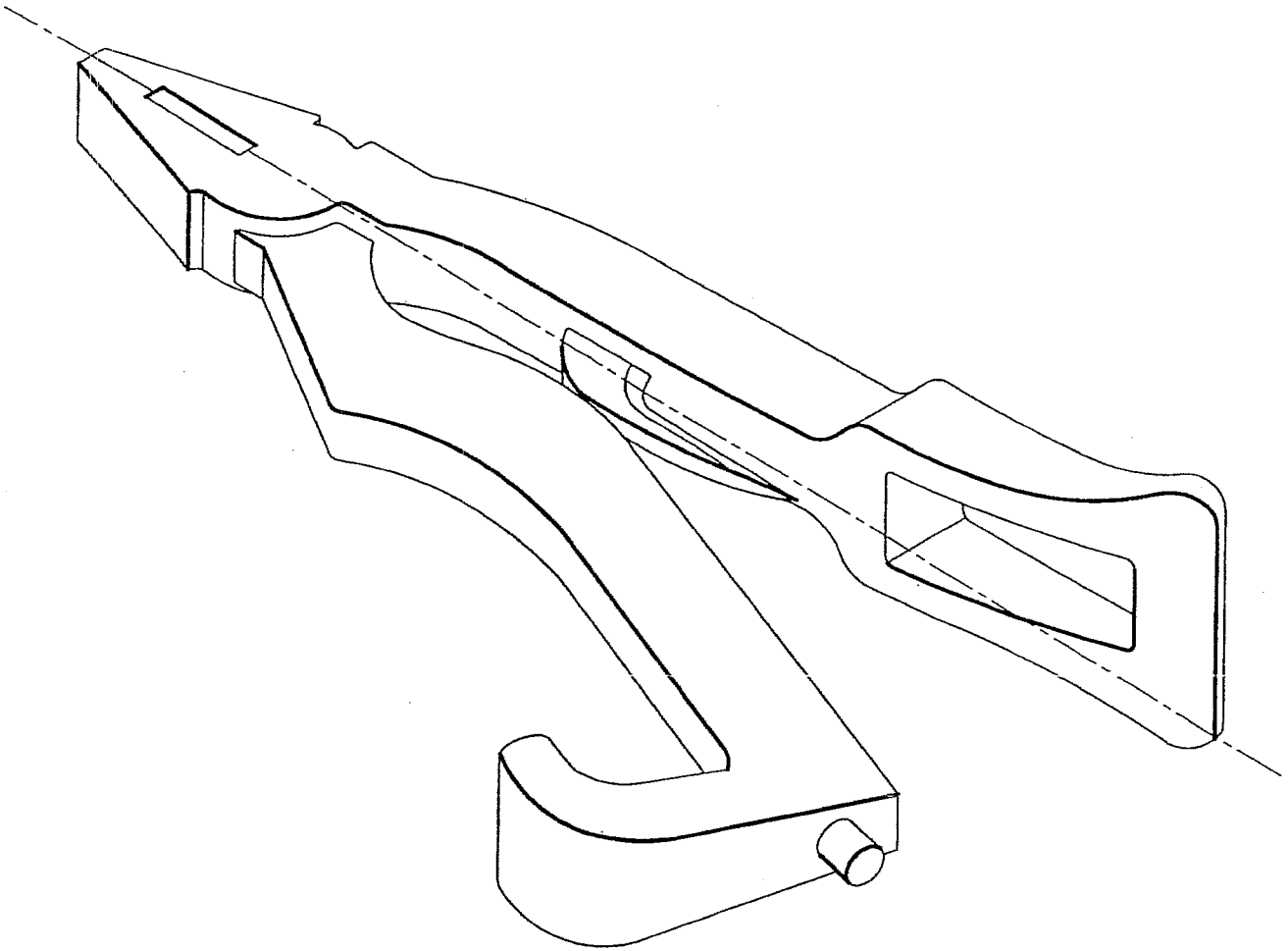
FIG. 1 PRIOR ART
FIG. 1. is a proximate end perspective view of a PRIOR ART multi-purpose rescue tool.
Figure 2:
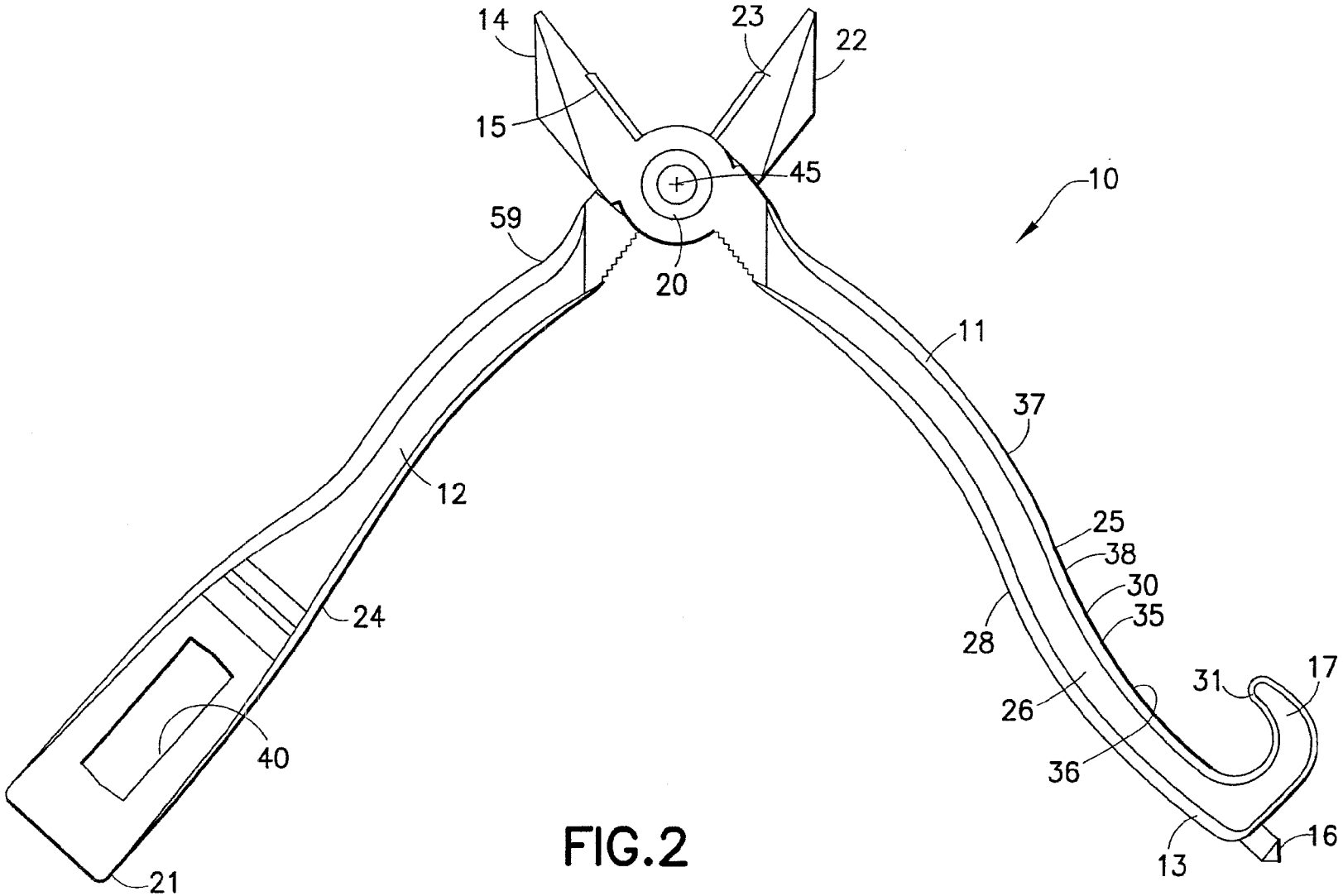
FIG. 2. is a front elevational view of the firefighter tool of the present invention in the fully opened position.

Referring to FIGS. 2-7 and 9, there is shown firefighter tool 10. Tool 10 includes members 11 and 12, pivotally connected by pivot member 20. Member 11 has a proximate end 13 and a distal end 14. Distal end 14 includes jaw 15. Proximate end 13 includes proximately disposed pin 16 and distally extending hook 17, and hook end 31 for purposes hereinafter appearing. Member 12 has a proximate end 21 and a distal end 22. Distal end 22 includes jaw 23. Member 12 includes handle portion 24. Member 11 includes handle portion 25 (see e.g., FIG. 6). Jaws 15 and 23 pivotably open and close with the movement of the handle portions 24 and 25, by pivot member 20.

Handle 25 is formed with a front surface 26, a rear surface 27, an inner surface 28 and an outer surface 30. Outer surface 30 is specifically configured in a generally sinusoidal curvature 35. Surface curvature 35 includes a proximately disposed concave portion 36, a convex portion 37, and an intermediate or transitional portion 38, for purposes hereinafter appearing. The respective radii of curvatures 36 and 37 are about equal. Handle 24 includes a wedge 39 formed at proximate end 21. A through hole wrench 40 is disposed between handle portion 24 and wedge 39. Through hole 40 is a parallel disposition with pivot axis 45 of pivot member 20.

Figure 3:
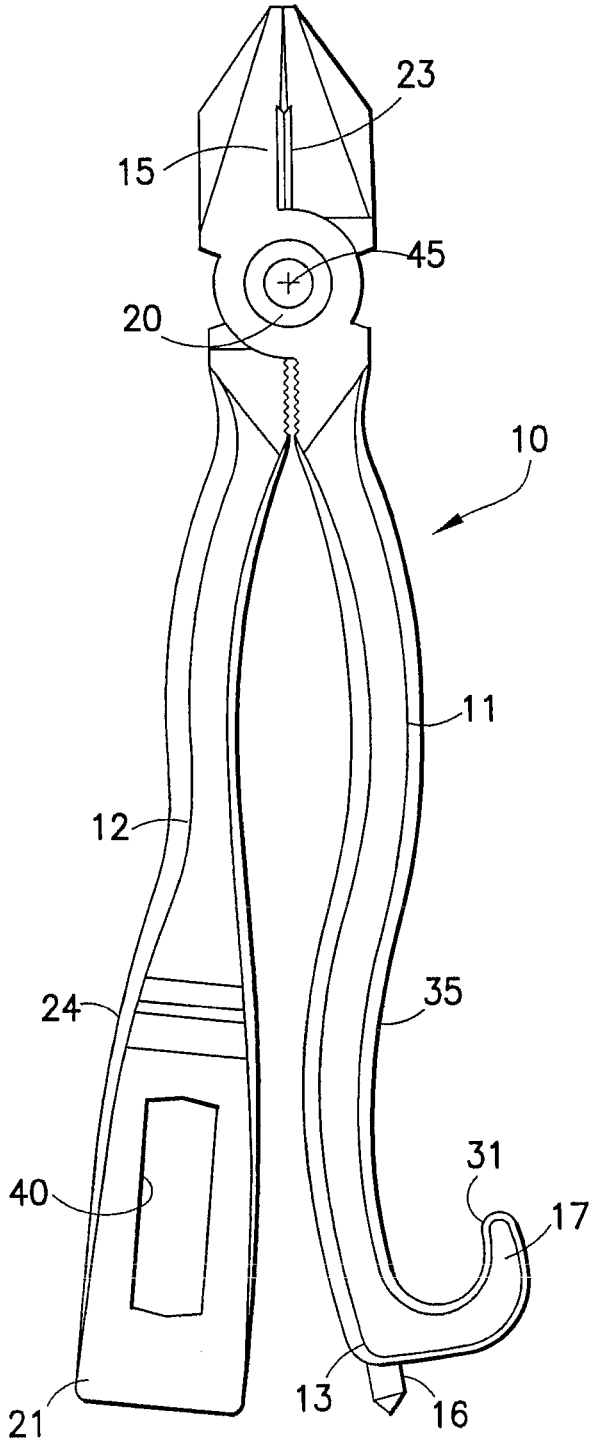
FIG. 3. is a front elevational view of the firefighter tool of FIG. 2 in the fully closed position.
Figure 4:
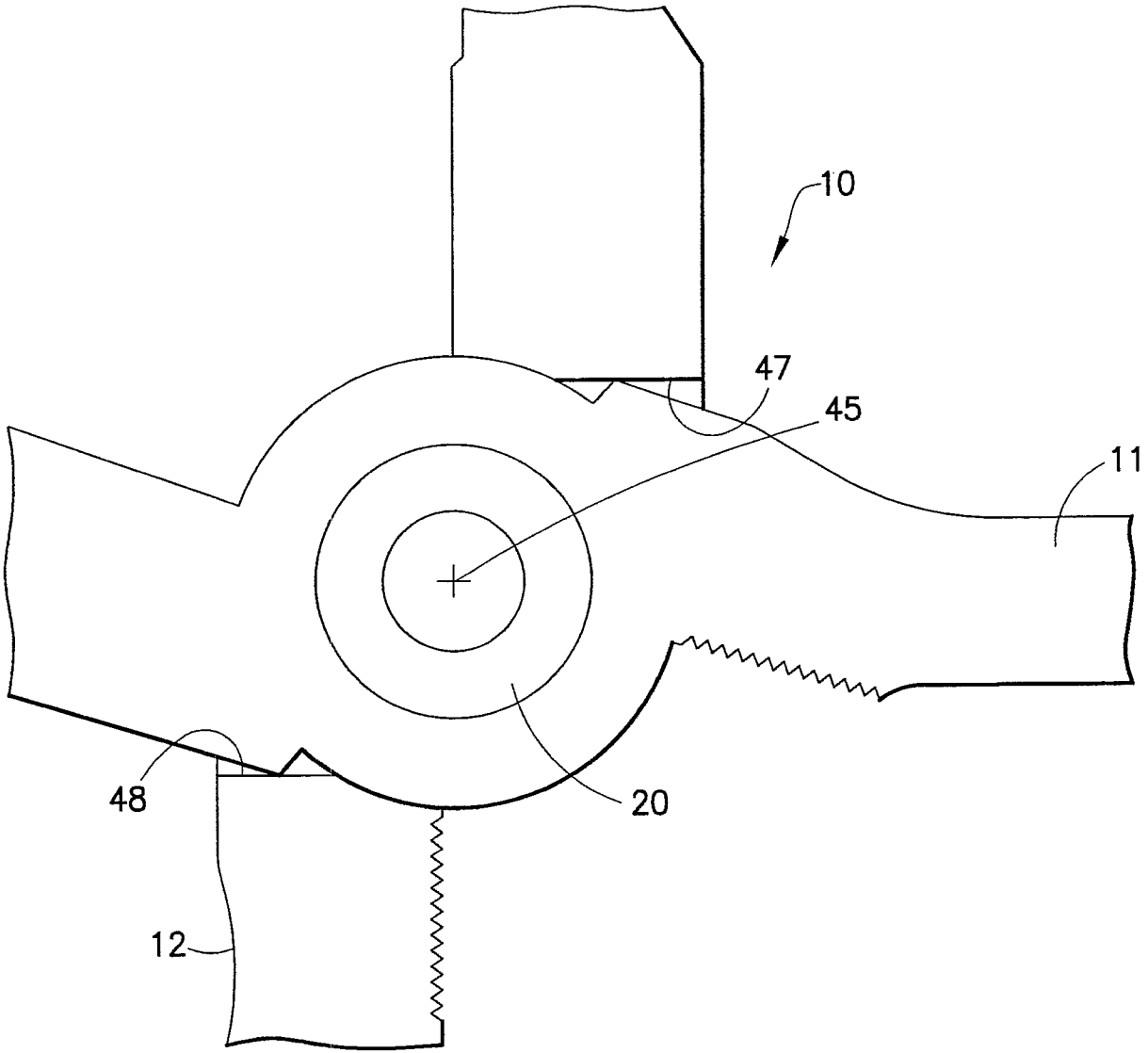
FIG. 4. is a greatly enlarged fragmentary view of the pivot assembly as shown in FIG. 2.

Referring specifically to FIG. 3, there is shown tool 10 in the fully closed position. Jaws 15 and 23 are contactingly engaged. A user (not shown) can grip closed jaws 15 and 23 and use wedge 21 or wrench 40 of member 12. The user (not shown) can otherwise grip closed jaws 15 and 23 and use configured surface 35 in cooperation with hook end 31 for uncoupling a fire hose coupling, as more fully discussed hereinafter.

Figure 5A:
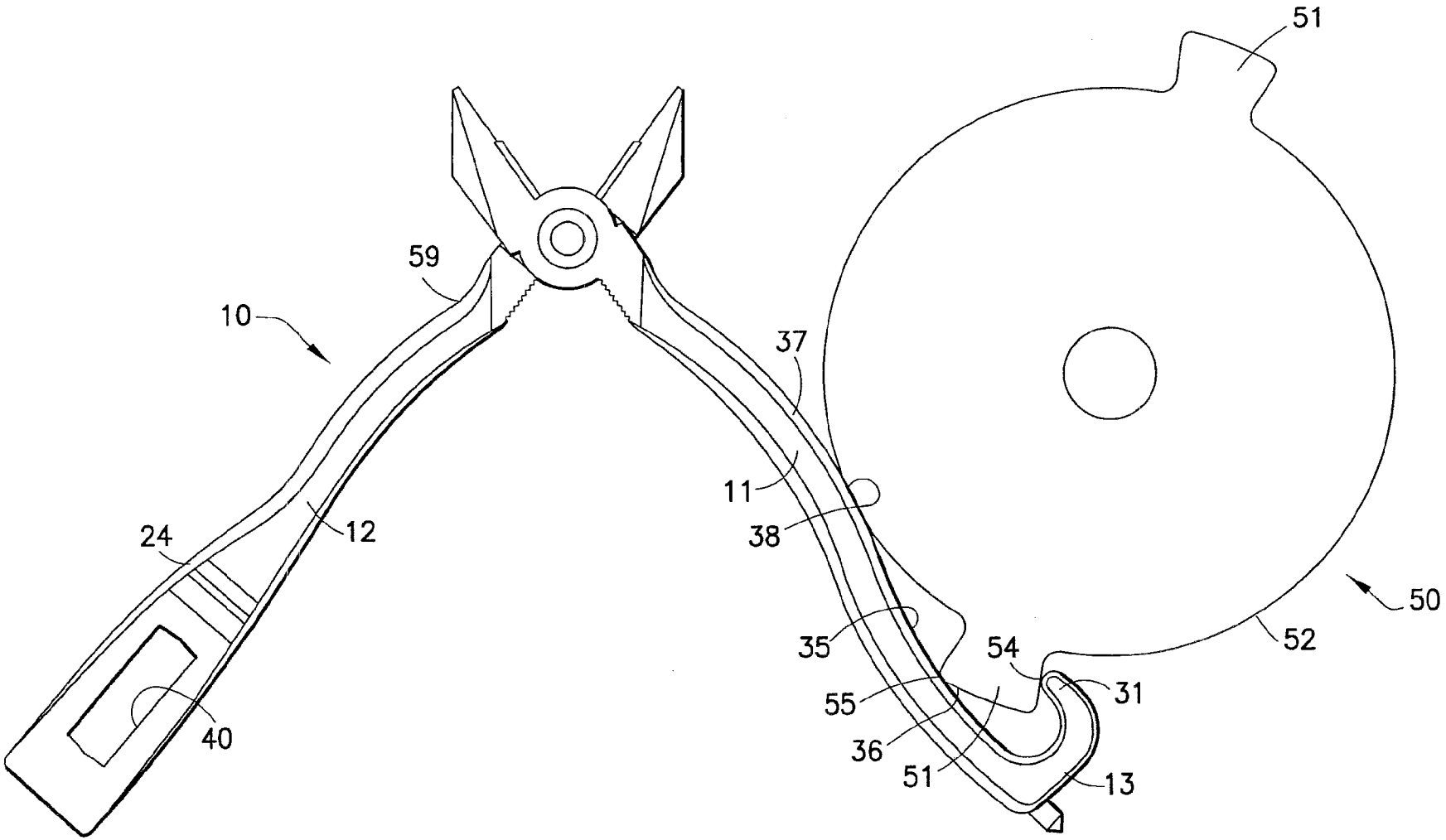
FIG. 5A. is a front elevational view of the firefighter tool of FIG. 2 in use with a fire hose coupling of a first size.

Referring specifically to FIG. 5A there is shown firefighter tool 10 in the fully opened position. Tool 10 is shown in operable engagement with a 5" fire hose coupling 50. Coupling 50 has 2 radially extending lugs 51 (typical), and cylindrical surface 52. It is understood that fire hose couplings are differently diametrically sized with differently configured and numbered lugs.

The user (not shown) grips handle 24 of member 12 and causes hook end 31 in combination with facingly opposed surface 35 to engage coupling 50 (FIG. 5A). With respect to the 5" coupling, hook end 31 engages lug recess 54, concave surface 36 lug engages corner edge 55, and transitional surface 38 engages coupling cylindrical surface 52 (FIG. 5A). The user then exerts an upward force on member 12, which force is transmitted through bearing surfaces 47 and 48 (FIG. 4) to member 11. The exerted force is in turn transferred through surfaces 38 and 36, and hook end 31 to coupling 50 to rotate (counter clockwise as shown in FIG. 5A) to uncouple coupling 50.

The present construction is designed to cause member 11 and 12 to open to at least about a 70° angle (FIG. 9) when operated in the fully opened mode. This large angular disposition in combination with the force transfer bearing surfaces 47 and 48 cause a substantial torque to be exerted on the coupling. It has been found that when a 250 lb. force is exerted on handle 24 in both the upward and sideward directions a resultant 354 lb. force is generated at 45°. Further, a Von Mises (WCS) stress analysis reveals that the area of highest stress is not in the pivot member 20 area but rather at portion 59 of member 12. The pivot member 20 and bearing surfaces 47 and 48 were found to be surprisingly under low stress. This construction permits an effective torque force to be generated without damage or deformation in and to the pivot member area engaged surfaces.

Figure 5B:
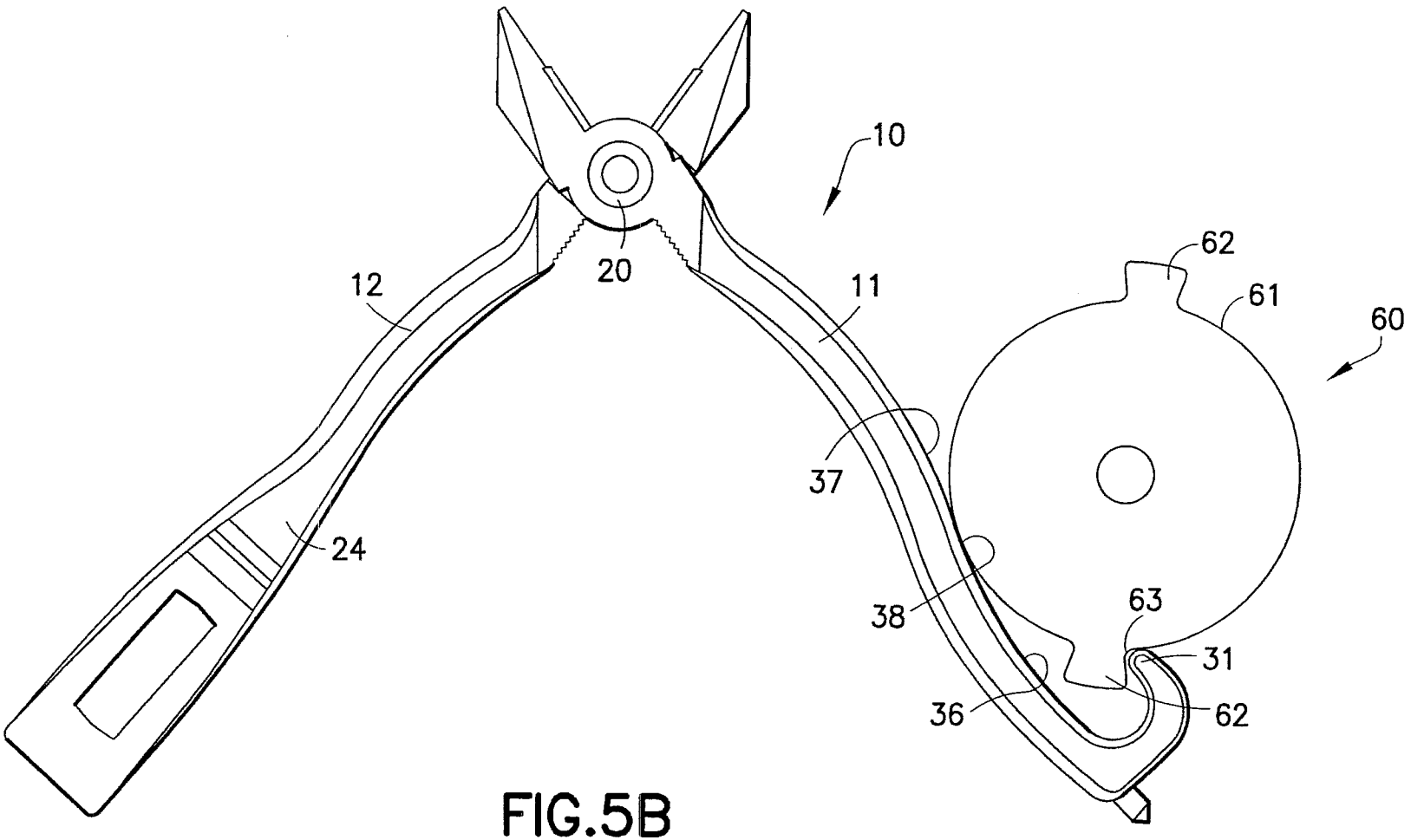
FIG. 5B. is a front elevational view of the firefighter tool of FIG. 2 in use with a fire hose coupling of a second size.

Referring specifically to FIG. 5B, there is shown tool 10 in operable engagement with 3" coupling 60. Coupling 60 includes cylindrical surface 61 and lugs 62. Lug 62 (typical) and cylindrical surface 61 converge at recess 63. The user grips handle 24 and causes hook end tip 31 to be inserted in recess 63, with transitional surface 38 contactingly engaged with coupling cylindrical surface 61. The user then exerts an upward force on handle 24 to generate a resultant torque force on coupling 60.

Figure 5C:
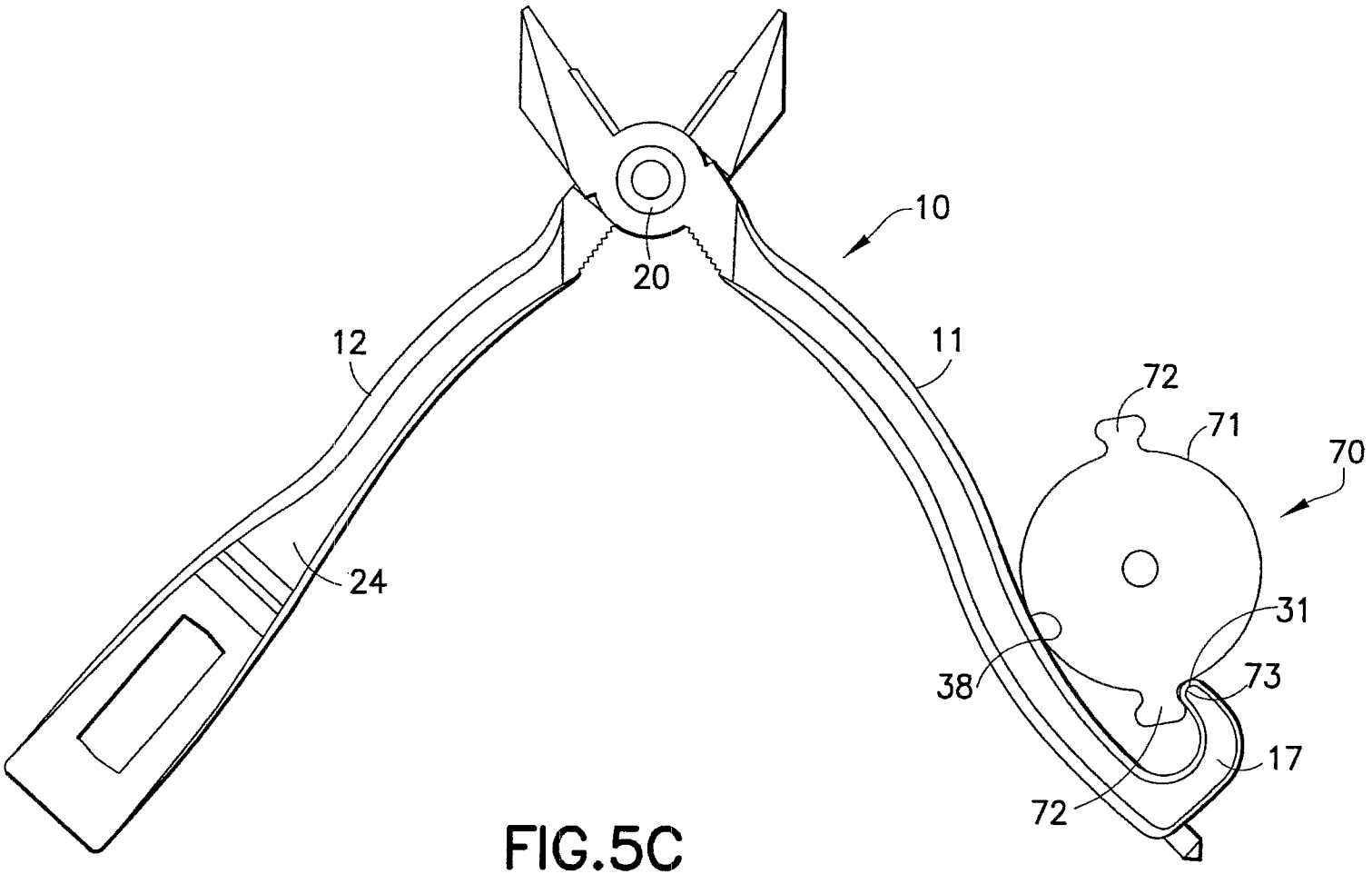
FIG. 5C. is a front elevational view of the firefighter tool of FIG. 2 in use with a fire hose coupling of a third size.

Referring specifically to FIG. 5C, there is shown tool 10 in operable engagement with 1½"-2" coupling 70. Coupling 70 includes cylindrical surface 71 and lugs 72. Lug 72 (typical) and cylindrical surface 71 converge at recess 73. The user grips handle 24 and causes hook end 31 to fit into recess 73 and transitional surface 38 to contactingly engage cylindrical surface 71. The user then, in a likewise manner, exerts an upward force to generate a resultant torque force on coupling 70.

Figure 6:
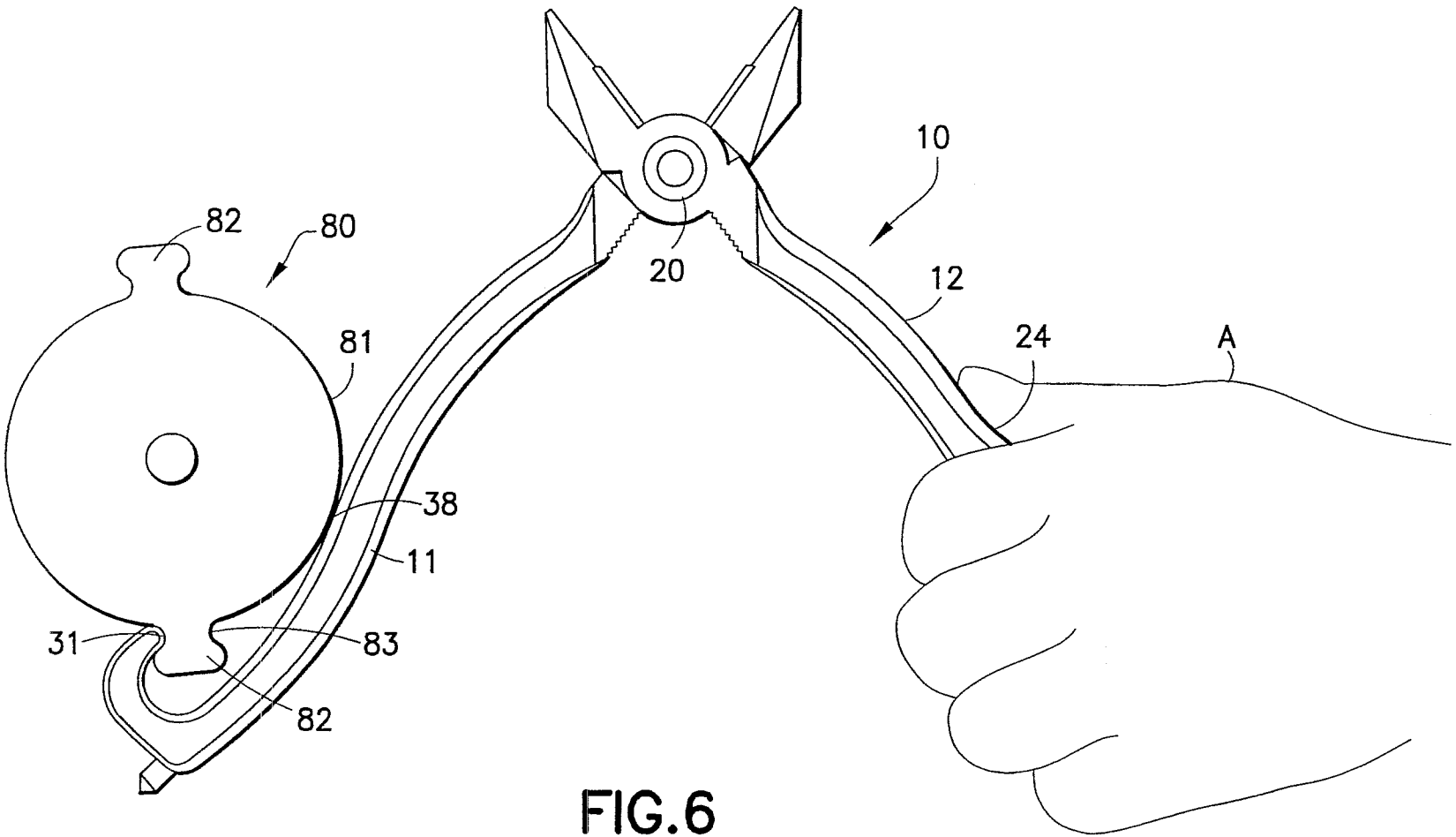
FIG. 6. shows the firefighter tool as in FIG. 5B being operably equipped by the firefighter.

Referring specifically to FIG. 6, there is shown a reverse side elevational view of tool 10 in operable engagement with 3" coupling 80. Coupling 80 differs from coupling 70 in that the lugs 82 are differently configured than lugs 72. The user A causes hook tip 31 to be inserted in recess 83 and transitional surface 38 to contactingly engage cylindrical surface 81. A torque force is then exerted in the above-described manner. FIGS. 5A-5C and 6 demonstrate the fully opened mode tool 10 in operable engagement with differently sized and configured fire hose couplings. The present invention provides a universal tool for readily uncoupling diversely sized and configured fire hose couplings.

Figure 7:
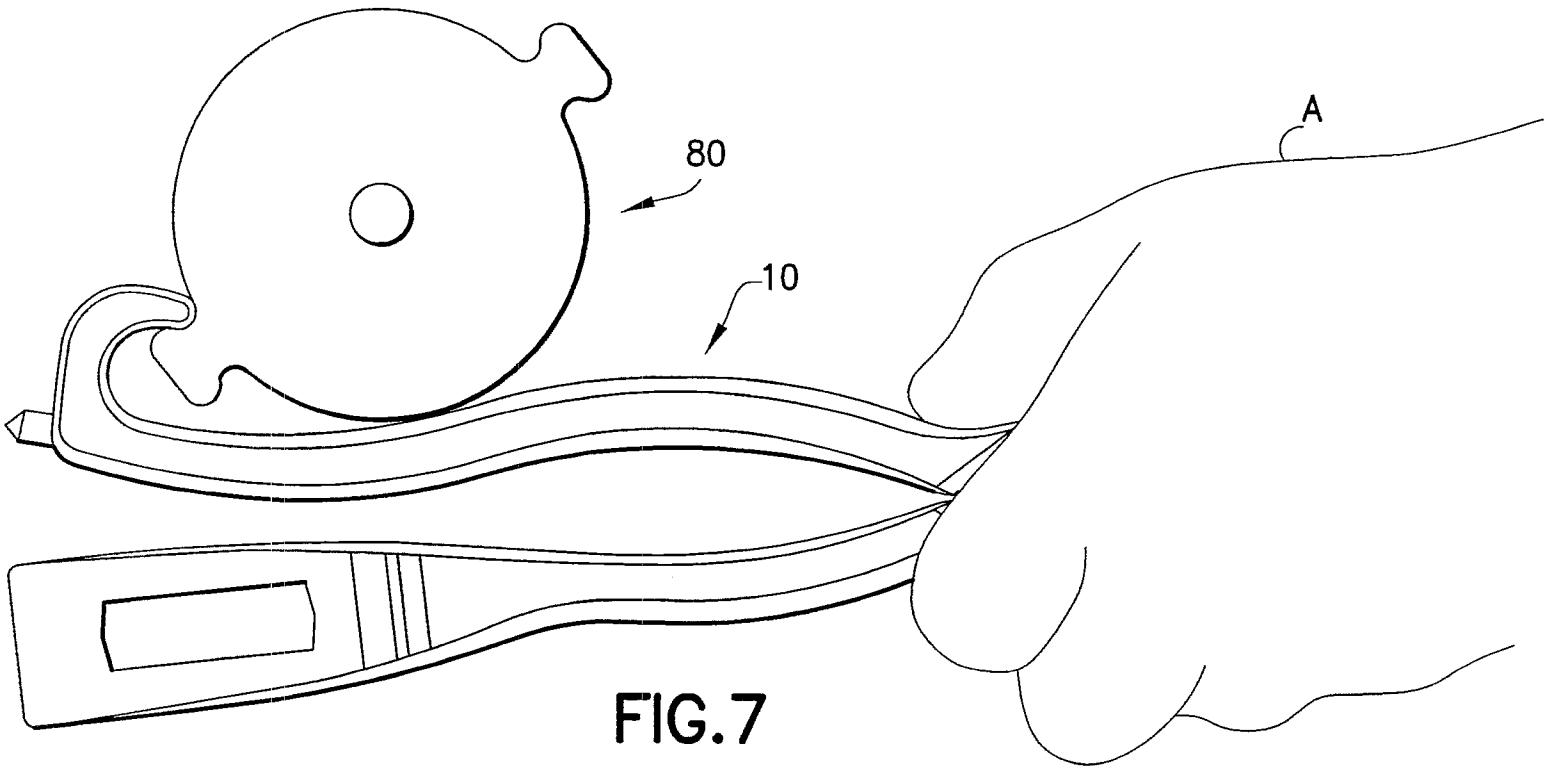
FIG. 7. shows the firefighter tool as in FIG. 3 being operably gripped by the firefighter.

Referring specifically to FIG. 7 there is shown tool 10 in the fully closed mode in operable engagement with coupling 80. The user A grips the surfaces formed by closed jaws 15 and 23, and exerts a downward force to uncouple coupling 80.

Figure 9:
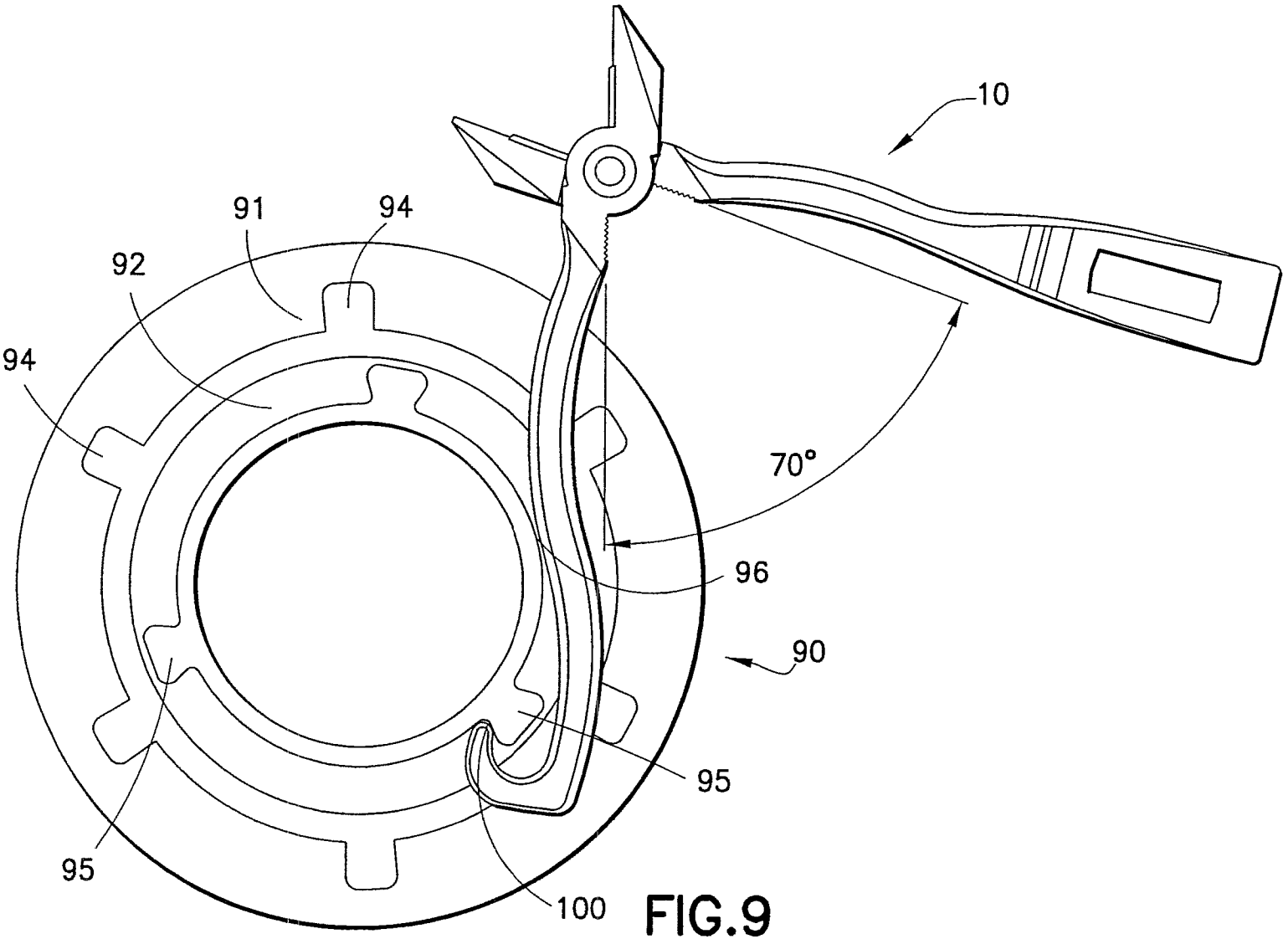
FIG. 9. is the firefighter tool of FIG. 2 operably engaging a 3" reducing coupling of a 5" coupling.

Referring specifically to FIG. 9, there is shown tool 10 in the fully opened mode in operable engagement with a standard 5" to 3" reduction coupling 90. Reduction coupling 90 is a one-piece unitary forge metal or molded impact resin construction, as is well known in the firefighter tool art. Reduction coupling 90 is formed with a rearwardly disposed 5" coupling engagement portion 91, and a forwardly disposed 3" coupling 92. Portion 91 is designed to fit over or cover standard 5" couplings. The six lug covers 94 engage two or more of the respective 5" coupling lugs. In this manner of construction, the 5" coupling is reduced to a 3" coupling. The resultant 3" coupling is designed with 3 lugs 95. Tool 10 engages one lug 95 and cylindrical surface 96. The user causes the 3" coupling and in turn the entire reduction coupling 90 to rotate and in turn uncouple the reduction coupling 90 covered 5" coupling (not shown).

Figure 8:
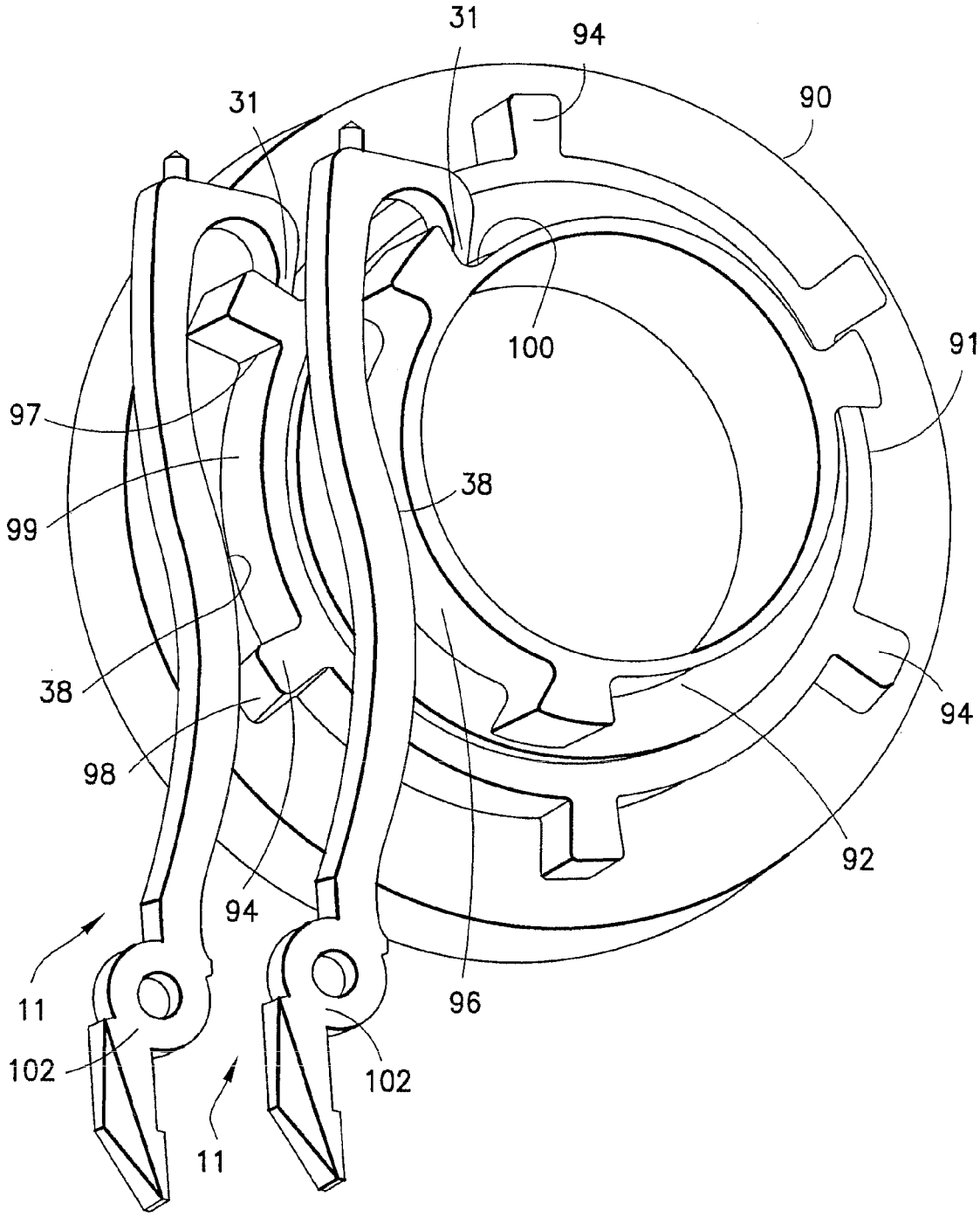
FIG. 8. shows an alternate embodiment of the firefighter tool, alternatively engaging a 3" coupling with a 5" coupling.

Referring now specifically to FIG. 8, there is shown a second embodiment of the present inventories. In this embodiment, member 11 itself is utilized as a fire hose uncoupling tool. Member 11 is shown in alternate operable engagement of the 5" coupling portion 91 and the 3" coupling portion 92. In the 3" coupling portion 92 engagement, hook tip 31 engages recess formed between lug 94 and cylindrical surface 96 and transitional surface 38 contactingly engages cylindrical surface 96. The user grabs member 11 at the jaw and pivot surfaces 102 and exerts a downward force to cause rotation of reduction coupling 90. In the 5" coupling portion 91 engagement, hook tip 31 fits into recess 100 and convex surface 37 contactingly engages the outer surface 98 of lug 94. Transitional surface 38 does not contactingly engage and is systematically disjoined from 5" cylindrical surface 99. FIG. 8 demonstrates the use of one-piece unitary member 11 as a universal uncoupling tool.

It is understood and within the contemplation of the present invention to provide a one-piece unitary forged tool where a forged handle or ergonomic handle may be provided in lieu of the surfaces 102.

The other firefighter elements e.g. wrench 40, wedge 21, pin 16 and jaws 15 and 23 are used in the manner described in application Ser. No. 11/493,682, filed Jul. 26, 2006, published as Publ. No. 20080022815, which application is incorporated herein in its entirety by references thereto.

While the present invention has been described by reference to a specific embodiment, it should be understood that modifications and variations of the invention might be constructed without departing from the scope of the invention as defined in the appended claims.

What is claimed is:

1. A firefighter tool and seized fire hose coupling comprising:

(a) a first seized fire hose coupling of a plurality of diversely sized and configured fire hose couplings, said first seized coupling comprises a first diameter and circumference; and (b) a firefighter tool comprising;

a first member comprising a proximate end and a distal end, and a proximately disposed first handle comprising a grip and a distally disposed first jaw;

a second member comprising a proximate end and a distal end, and a proximately disposed second handle and a distally disposed second jaw;

means for pivotably connecting the members comprising a pivot axis, and being disposed between the handles and jaws so that the handles pivotably move the jaws from a first operable position to a second operable position;

wherein in said first operable position the jaws and handles are fully closed, and in said second operable position the jaws and handles are fully opened and subtend an angle of at least 70°; said jaws and handles comprise respective first and second contactingly engaged force bearing surfaces with the jaws and handles disposed at the said angle and do not open further in said second operable position;

said second handle comprises a hook for engaging a lug of the seized fire hose coupling, said hook being disposed at the proximate end of said second handle, said second handle further comprises a sinusoidal surface in combination with the hook in operable contacting engagement with the first seized fire hose coupling cylindrical surface and lug;

said first force bearing surfaces are more adjacent the first handle grip than the second force bearing surfaces and the second force bearing surfaces are more adjacent the second handle hook than the first force bearing surfaces with said first and second force bearing surfaces in the second operable position, and said first force bearing surfaces are more distally disposed than the second force bearing surfaces in the second operable position;

wherein the first handle grip is operable in the second operable position; whereby the firefighter grips the first handle grip and not the second handle and exerts a leverage force through the more distally disposed first force bearing surfaces and then through the second force bearing surfaces to the second handle sinusoidal surface and hook to exert a resultant torque force on the seized fire hose coupling to uncouple the seized fire hose coupling.

2. The firefighter tool and seized coupling of claim 1, said convex and concave surfaces comprise about equal radii of curvature.

3. The firefighter tool and seized coupling of claim 1, said hook comprises an end, said end comprises a tip, and said tip engages said lug.

4. The firefighter tool and seized coupling of claim 1, said sinusoidal surface comprises a convex portion, a concave portion and a transitional portion disposed between the convex and concave portions, said transitional surface being in contacting engagement with the fire hose coupling cylindrical surface in the second operable position.

5. The firefighter tool and seized coupling of claim 4, said convex and concave portions comprises about equal radii.

6. The firefighter tool and seized coupling of claim 5, said transitional portion is contiguous with the convex and concave surfaces.

7. The firefighter tool of claim 4, said transitional portion being disposed more adjacent the hook than the pivot axis.

8. The firefighter tool of claim 7, said convex and concave surfaces comprise about equal radii.

9. The firefighter tool and seized fire hose coupling of claim 1, said sinusoidal surface comprises a convex surface, a transitional surface and a concave surface, said transitional surface is disposed between and is contiguous with the convex surface and the concave surface, and the transitional surface, and not the convex and concave surfaces, is in contacting engagement with the fire hose coupling cylindrical surface.

10. The firefighter tool and seized fire hose coupling of claim 9, further comprising a second seized coupling disposed in place of the first seized coupling, said second seized coupling having a cylindrical surface and having a second diameter different than the first coupling diameter, and wherein the second coupling cylindrical surface contactingly engages the transitional surface and not the convex or concave surfaces in the second operable position, wherein an effective torque force is exerted to likewise quickly uncouple the second seized coupling.

11. The firefighter tool and seized coupling of claim 10, said first fire hose coupling comprises a first number of lugs and said second coupling comprises a second number of lugs, and said hook contactingly engages one lug of said first coupling or alternatively one lug of said second coupling, in the second operable position.

12. The firefighter tool of claim 11, each said first and second force bearing surfaces comprise a planar surface and an angular element and in contacting engagement; said planar surfaces being spacedly disposed in parallel disposition in said second operable position.

13. The firefighter tool and seized fire hose coupling of claim 1, each said first and second force bearing surfaces comprises a planar surface and an angular element.

14. The firefighter tool of claim 13, said planar surfaces being spacedly disposed in parallel disposition.

* * * * *